US008203095B2

(12) United States Patent
Storm et al.

(10) Patent No.: US 8,203,095 B2
(45) Date of Patent: Jun. 19, 2012

(54) METHOD OF USING A THERMAL PLASMA TO PRODUCE A FUNCTIONALLY GRADED COMPOSITE SURFACE LAYER ON METALS

(75) Inventors: Roger S. Storm, Tucson, AZ (US); Vladimir Shapovalov, Albuquerque, NM (US); James C. Withers, Tucson, AZ (US); Raouf Loutfy, Tucson, AZ (US)

(73) Assignee: Materials & Electrochemical Research Corp., Tucson, AZ (US)

( * ) Notice: Subject to any disclaimer, the term of this patent is extended or adjusted under 35 U.S.C. 154(b) by 1226 days.

(21) Appl. No.: 11/735,939

(22) Filed: Apr. 16, 2007

(65) Prior Publication Data

US 2008/0000881 A1 Jan. 3, 2008

Related U.S. Application Data

(60) Provisional application No. 60/745,241, filed on Apr. 20, 2006.

(51) Int. Cl.
*B23K 10/00* (2006.01)

(52) U.S. Cl. ..... 219/121.47; 219/121.59; 219/76.16; 148/206; 148/222

(58) Field of Classification Search ..... 219/121.47, 219/121.58, 121.59, 121.48, 121.4, 121.43, 219/121.41, 75; 428/610; 204/298.33; 148/222
See application file for complete search history.

(56) References Cited

U.S. PATENT DOCUMENTS

| | | | | |
|---|---|---|---|---|
| 3,944,443 | A | 3/1976 | Jones | 148/16.5 |
| 4,013,866 | A * | 3/1977 | Fox et al. | 219/121.36 |
| 4,244,751 | A | 1/1981 | Hioki et al. | 148/1 |
| 4,411,960 | A | 10/1983 | Mizuhara | |
| 4,451,302 | A | 5/1984 | Prescott et al. | 148/13.1 |
| 4,519,835 | A * | 5/1985 | Gauvin et al. | 75/10.19 |
| 5,062,900 | A | 11/1991 | Berneron et al. | |
| 5,294,264 | A | 3/1994 | Tiegs et al. | 148/207 |
| 5,306,531 | A | 4/1994 | Laurence et al. | |
| 5,366,345 | A | 11/1994 | Gerdes et al. | 416/241 |
| 5,383,980 | A | 1/1995 | Melber et al. | 148/222 |
| 5,443,663 | A | 8/1995 | Meletis | 148/222 |
| 5,518,605 | A | 5/1996 | Hadj-Rabah et al. | 205/148 |
| 5,679,167 | A | 10/1997 | Muehlberger | |
| 5,830,540 | A | 11/1998 | Bowers | |

(Continued)

FOREIGN PATENT DOCUMENTS

EP 0 491 075 6/1992

(Continued)

OTHER PUBLICATIONS

European Supplementary Search Report for Appln. No. 07782067.8-1215/2007543, dated Apr. 18, 2011, 11 pages.

(Continued)

*Primary Examiner* — Mark Paschall
(74) *Attorney, Agent, or Firm* — Hayes Soloway P.C.

(57) ABSTRACT

A method of material treatment in which the surface of a metal substrate is converted to a composite structure of the metal and its nitride or carbide utilizing a high temperature chemically active thermal plasma stream, and the product obtained from that method. The complex thermal plasma contains controllable additions of active gas, liquid or solid substances. The surface layer obtained is functionally graded to the substrate resulting in an excellent bond that resists delamination and spalling, and provides a significant increase in hardness, wear and erosion resistance, and corrosion resistance, and a decrease in coefficient of friction.

18 Claims, 6 Drawing Sheets

U.S. PATENT DOCUMENTS

| | | | | |
|---|---|---|---|---|
| 6,105,374 | A | 8/2000 | Kamody | |
| 6,179,933 | B1 | 1/2001 | Dodd et al. | 148/222 |
| 6,602,353 | B1 | 8/2003 | Kanbe et al. | 148/222 |
| 6,645,566 | B2 | 11/2003 | Ko | |
| 2003/0233977 | A1 | 12/2003 | Narendar et al. | |
| 2005/0208218 | A1 * | 9/2005 | Becker et al. | 427/248.1 |

FOREIGN PATENT DOCUMENTS

| | | | |
|---|---|---|---|
| EP | 1 319 733 | A2 | 6/2003 |
| EP | 1 340 837 | A1 | 9/2003 |
| JP | 57 057867 | | 4/1982 |
| JP | 62 188771 | | 8/1987 |
| JP | 10 265937 | | 10/1998 |

OTHER PUBLICATIONS

Chinese Office Action (with English Translation) for Appln. No. 2007/80000726.3, dated Mar. 15, 2011, 17 pages.

Chinese Official Action and translation dated Nov. 10, 2011 issued in corresponding Chinese Application Serial No. 200780000726.3 (7 pgs).

* cited by examiner

Surface
Zone 1

Center
Zone 2

Transition to Ti-6-4
Zone 3

METHOD OF USING A THERMAL PLASMA TO PRODUCE A FUNCTIONALLY GRADED COMPOSITE SURFACE LAYER ON METALS

CROSS REFERENCE TO RELATED APPLICATION

This application claims priority from U.S. Provisional Application Ser. No. 60/745,241, filed Apr. 20, 2006, the contents of which are incorporated herein by reference.

TECHNICAL FIELD

The present invention relates to methods of thermo-chemical treatment and composite material fabrication for metals which can form ceramic structures such as nitrides, carbides, and mixtures thereof.

BACKGROUND OF THE INVENTION

Several hardening methods are described in the literature that are implemented in static environments. In particular, there is plasma nitriding by means of a low temperature plasma gas intensified by a thermionic emission source (U.S. Pat. Nos. 5,294,264 and 5,443,663), a bath of salts (U.S. Pat. Nos. 5,518,605; 6,645,566), powder (U.S. Pat. No. 6,105,374), and by means of low temperature ion nitriding (U.S. Pat. No. 6,179,933). A technique of ion implantation has been proposed (U.S. Pat. Nos. 5,383,980; 6,602,353).

There also exists a non-static method in which a laser beam that is movable relative to the substrate is directed onto the substrate and produces surface melting in the impact zone. Nitrogen is blown onto the substrate in a direction that remains fixed relative to the direction of the laser beam, and an inert gas is also blown onto the piece (EP-A-0 491 075). In that method, the nitrogen is mixed with the inert gas and both the laser beam and the nitrogen-inert gas jet converge on the piece so that the gaseous mixture strikes the liquid zone. To prevent said zone being converted into a spray, it is necessary to limit the pressure of the gas jet. This method has made it possible to obtain hardening of a Ti alloy over a thickness of 400-1000 microns.

U.S. Pat. No. 3,944,443 describes the application of a high temperature induction plasma with a combination of nitrogen gas with either propane or $BF_3$ to achieve hard surface layers up to 250 microns. The object to be coated must be electrically isolated.

U.S. Pat. No. 4,244,751 describes melting the surface (but does not describe ionizing the nitrogen molecules) of Al with a plasma torch (TIG) to obtain a hard surface. The thickness of the surface layer is <200 microns.

U.S. Pat. Nos. 5,366,345 and 4,451,302 describe hardening of a metal substrate using a laser or e-beam with melting of the surface in nitrogen.

SUMMARY OF THE INVENTION

A method of thermo-chemical treatment of the surface of metal substrates by nitriding, carbiding, and carbonitriding. The basis of the method is the use of a high temperature ionized gas arc plasma stream at ambient pressure. The method of the invention makes it possible to obtain hardening over a much greater thickness (up to but not limited to 10,000 microns), at a much faster rate and using much simpler and less expensive means than would be required for a laser or other arc type device. This can be accomplished with or without melting of the surface.

Nitrogen or a nitrogen containing gas mixture is directed into the plasma stream wherein the work piece is one electrode of the plasma source. At very high plasma temperatures, nitrogen molecules split into atoms and the atoms ionize to ions. The ions are blended with a gas plasma stream, typically Ar or He, or a mixture of Ar and $H_2$, and reach the metal substrate surface in a very energetically active ion state of high energy. Absorption and reaction of the ions occurs much more rapidly than for the corresponding non-ionized molecules. In addition, since the metal work piece is one electrode that creates the plasma, the plasma stream heats the metal substrate surface very fast and the surface can reach temperatures near to the melting point of the metal in fractions of second, on the order of hundredths of a second.

Without surface melting, the converted layer of the substrate can be up to 1 or more mm thick. With melting of the surface, the converted layer can be up to 6 or more mm thick. For a Ti-6Al-4V substrate, the hardness obtained without melting can range from about 45-85 as measured by the Rockwell C method.

The method can be used for Ti and Ti alloys as well for Al, Cr, Fe, Co, Ni, Nb, Ta, V, Zr, Mo, W, Si and their alloys. These metals form very hard nitrides and carbides.

BRIEF DESCRIPTION OF THE DRAWINGS

The invention is now described in greater detail with reference to a particular embodiment given by way of non-limiting example and shown in the accompanying drawings, in which.

DETAILED DESCRIPTION OF THE INVENTION

Figure 1:
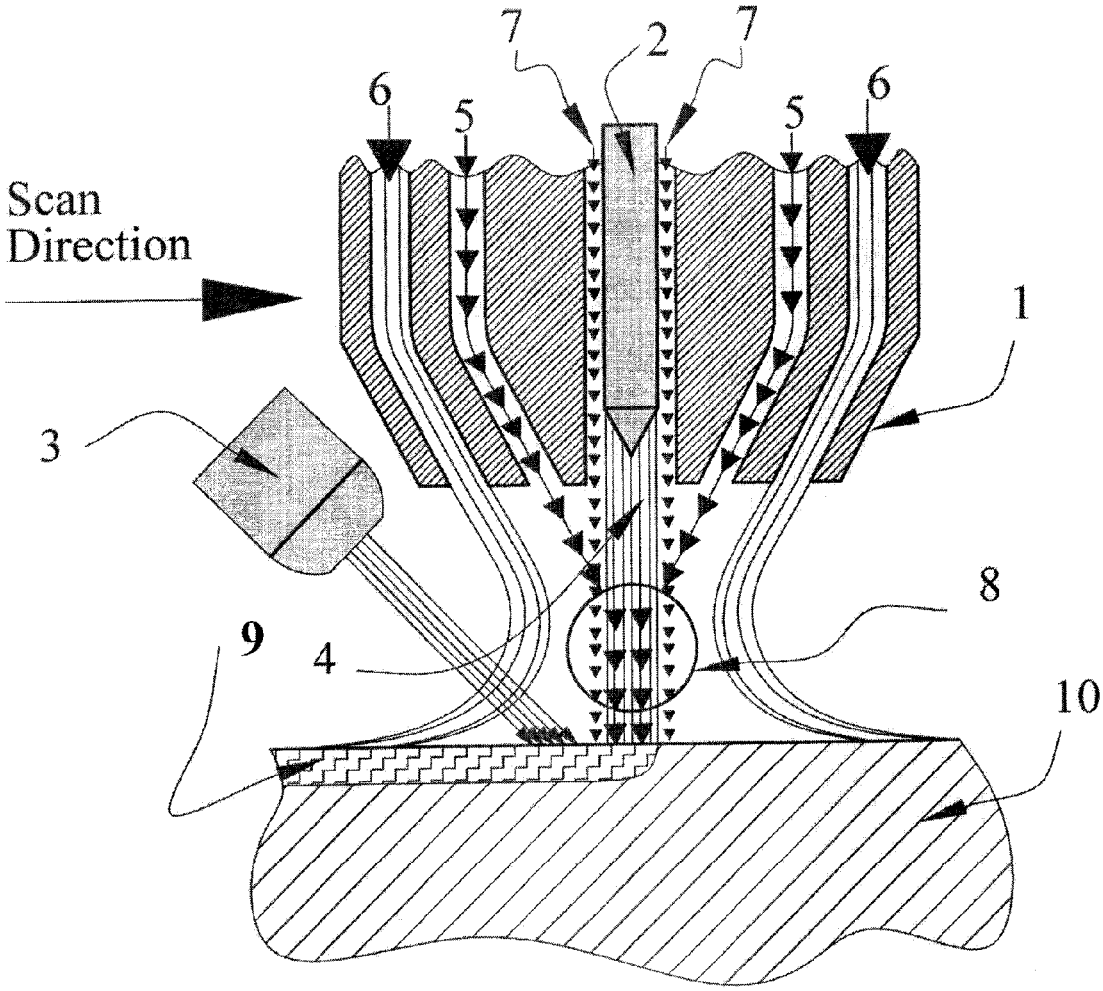
FIG. 1 shows a schematic view of a plasma torch apparatus for practicing the present invention comprising a plasma transferred arc (PTA) torch (1) containing a non-consumable W electrode (2), gas impingement cooling (3), plasma stream (4), powder feed channels which are used to feed nitrogen directly to the plasma stream (5), shield gas stream (6), torch (arc) gas stream (7), mixing zone (8), and work piece (10) having thermo-chemical treated zone (9) with or without surface remelting.

Referring to FIG. 1 for practicing the present invention, a plasma torch (1) is used wherein the work piece forms one of the electrodes whose plasma stream (4) strikes a suitable metal substrate (10) that is situated at a distance from the torch head (1) of about 10-50 mm. Nitrogen or a nitrogen containing gas mixture under ambient pressure is blown through small-diameter (1-3 mm), nozzle-type cylindrical holes (5) within the torch body (1). These cylindrical holes are normally used in the plasma transferred arc (PTA) torch to flow metal or other powder into the plasma arc. The nitrogen stream is thus directed into the plasma stream (4) at a relative angle of about 15°-70°. The mixing zone (8) should be located about 1-30 mm above the surface of the substrate (2). The gas cooling jet (3) is located external to the torch (1) but is rigidly bound to it such that it is located aft of the location of plasma impingement on the substrate during scanning. The cooling jet (3) utilizes a cooling argon stream which is directed onto the plasma heated area (9) at a variable angle which can be selected based on the cooling rate necessary. Additional protection from oxygen in the process area is accomplished by means of a shield gas, usually argon or $N_2$ (6), which is introduced by an annular channel in the torch body or alternatively can be delivered separately by the tubular arrangement that forms a shield that prevents oxygen contact with the heated surfaces. The power of the plasma stream (4), and the displacement speed of the torch are adjusted so as to control the degree of temperature rise of the metal substrate (10) in the form of an area having a diameter of about 5 mm to 25 mm and a depth of about 1 mm to 5 mm. Nitrogen is absorbed and reacted in the contact zone between the active plasma mix stream (8) and the substrate (10).

By adjusting the velocity of the nitrogen stream (5) to within the range from about 0.1 meters per second (m/s) to about 10 m/s, the nitrogen is caused to penetrate into the plasma mixing zone (8) resulting in an active argon plasma containing nitrogen ions. Changing the nitrogen stream speed results in a change in the nitrogen content of the treated layer (9).

Another possible method to change the composition and structure of the surface layer is to change the torch motion parameters during scanning, including rate of forward travel, and oscillation speed and width. At a constant plasma stream (4) power, the nitrogen content in the surface layer has an inverse proportionality relationship to torch speed. A forward travel rate of about 10 mm/min to about 500 mm/min is within a range that produces useful results.

Figure 2:
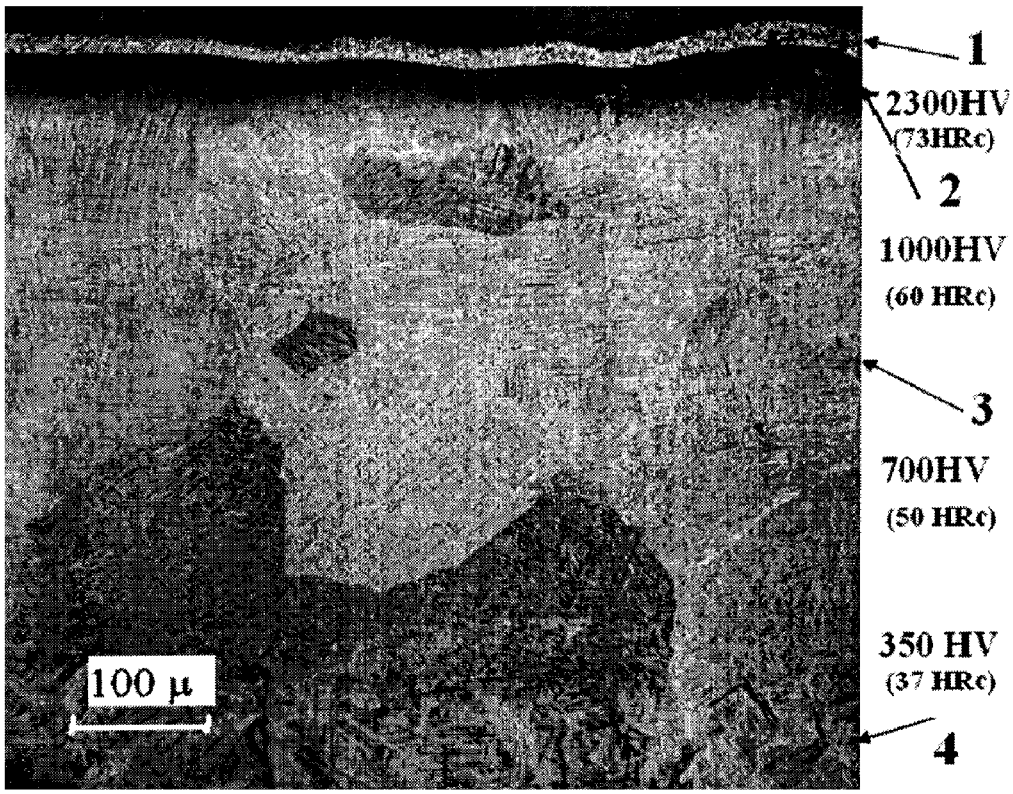
FIG. 2 is an optical micrograph of the etched TiN/Ti composite surface layer on a Ti-6Al-4V substrate formed without melting using a high temperature $N_2$ plasma illustrating the functionally graded transition from the surface to the substrate: 1—TiN layer approximately 60 microns thick; 2—zone with a high concentration of nitrogen with a thickness up to approximately 100 microns; 3—transition zone with a thickness approximately 2000 microns; 4—initial Ti-6Al-4V substrate. Hardness of each zone is shown in microhardness and Rockwell C. Image height is 2500 microns.
Figure 3A:
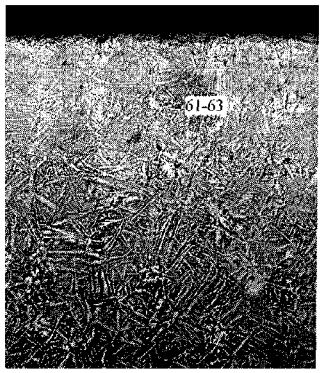
FIGS. 3A-3C are higher magnification optical micrographs of an etched TiN/Ti surface layer produced with surface melting. Insets refer to Rockwell C hardness of various points in the surface layer, which is highest near the surface and decreases moving away from the surface, illustrating the functionally graded interface. The Rockwell C hardness of the base Ti-6Al-4V substrate is 34-39. Image height is 400 microns.
Figure 3B:
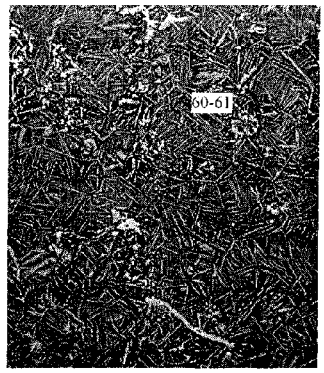
Figure 3C:
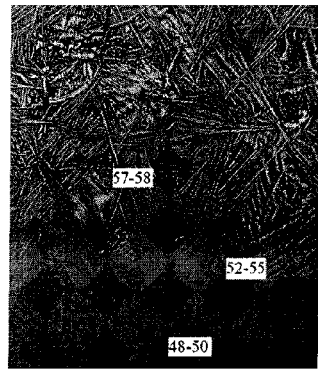
Figure 4:
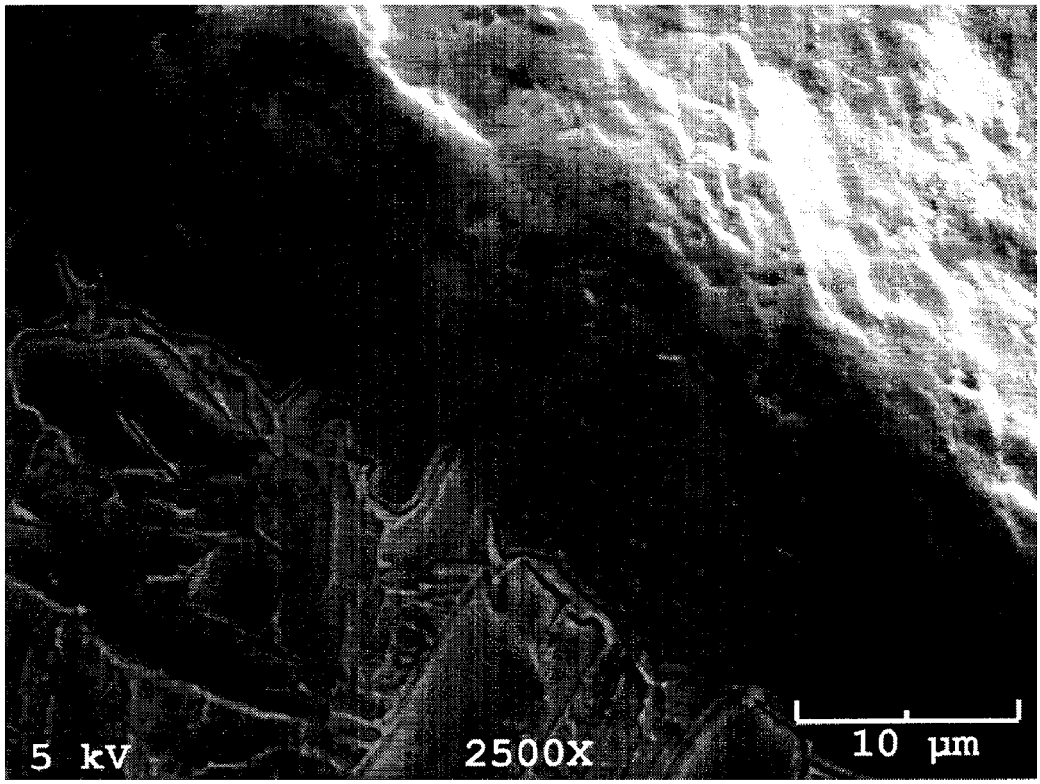
FIG. 4 is a very high magnification scanning electron micrograph (SEM) at the surface zone 1 in FIG. 3A, illustrating the excellent bonding between the TiN layer and at the center zone 2 (FIG. 3B) which has a high concentration of nitrogen.
Figure 5:
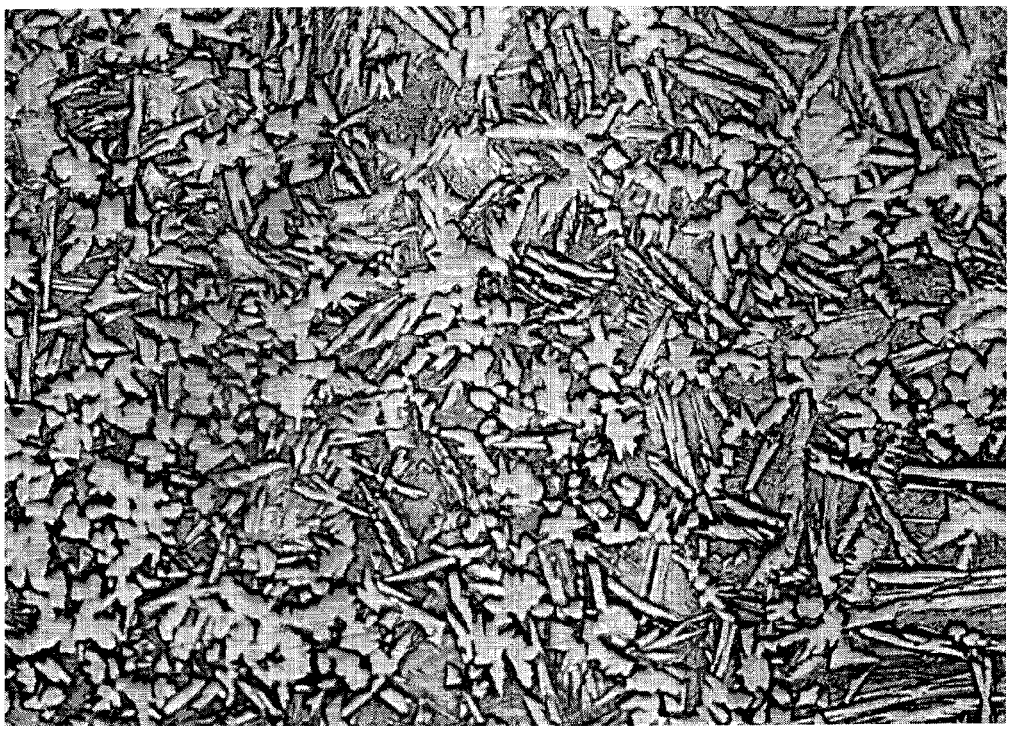
FIG. 5 is a high magnification optical micrograph of the etched TiN/Ti at the transition zone 3 in FIG. 3C, illustrating the composite structure. The light phase is TiN, and the dark phase is Ti-6-4. Image height is 100 m microns.

For the case of a Ti-6Al-4V substrate, the ratio of N atoms to Ti atoms in the surface layer after treatment without melting is about 5% to about 49%, based on pure TiN having a ratio of 50%, and pure Ti having a ratio of 0%. The surface hardness after treatment without melting is up to about 85 HRC. In the treated samples the hardness of the surface layer decreases as the distance from the surface increases. This decrease is proportional to a corresponding decrease in the ratio of TiN to Ti atoms as the distance from the surface increases. This is illustrated in FIG. 2 for a Ti-6Al-4V substrate which was coated without melting of the surface, and in FIG. 3 for a Ti-6Al-4V substrate which was coated with surface melting. The corresponding hardness of the untreated Ti-6Al-4V substrate is 34-39 HRC. FIG. 4 shows an SEM of a nitrided surface layer on Ti-6Al-4V illustrating the excellent bonding between a thin layer at the top most surface with a very high TiN/Ti ratio to a layer with lower TiN/Ti ratio.

The nitrided surface has a 3 phase structure consisting of alpha Ti, beta Ti and TiN crystals. In addition, a slightly harder beta-type structure of said alloy that is derived from fast thermal transformation during cooling which may be interposed between the nitrided portion and the alpha/beta-type Ti-6Al-4V structure.

In some special applications, conventional processing for surface layer deposition cannot be utilized to produce a coating and in particular carbide coatings. In vacuum carburizing a typical precursor is a hydrocarbon such as cyclohexane which contains hydrogen. Many steels and titanium are sensitive to hydrogen and can't be treated by the conventional processing, whereas the PTA surface treatment modification process can utilize a solid carbon source such as carbon black or fullerenes to carbonize and eliminate any adverse reactions with hydrogen and the substrate.

The invention will now be described with reference to the following non-limiting examples.

EXAMPLES

Example 1

A Ti-6-4 substrate was placed in the inert chamber of a rapid prototyping apparatus in which a plasma transferred arc (PTA) welding torch was used as the heat source. The torch position and operating parameters were controlled by a computer operated 3-D CNC positioning means. The torch operating parameters were also controlled by the same computer. The inert gas chamber of the rapid manufacturing apparatus was purged with Ar gas until the oxygen level reached 25 ppm of oxygen. Ar gas was flowed through the torch gas holes of the PTA torch and nitrogen gas was flowed through the shield gas holes. No gas was flowed through the powder feed channels. The amperage for the PTA torch was set at 52 amps and torch forward speed was set at 0.3 IPM. The surface of the Ti-6Al-4V substrate was scanned with the torch, so as to avoid melting of the substrate surface. After cooling to room temperature, the Rockwell C hardness ($R_C$) of the substrate was measured as 38, the same as an untreated Ti-6-4 substrate. This clearly illustrates that in the absence of a reactive gas to form e.g. a carbide or nitride, no surface layer of increased hardness is formed.

Example 2

Example 1 was repeated with a nitrogen flow of 7 SCFH through the powder feed holes. After cooling to room temperature, the $R_C$ was measured as 65.

Example 3

Figure 6:
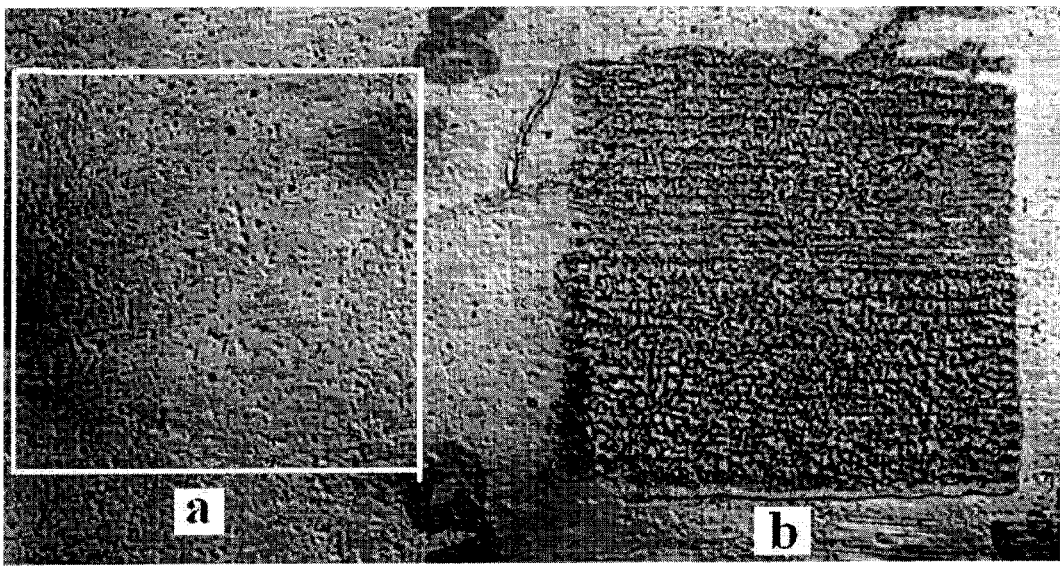
FIG. 6 shows the appearance of a Ti-6Al-4V work piece subjected to a high temperature thermal plasma without surface melting (a) Ar plasma, (b) Ar/Nitrogen plasma, showing the effect of directly introducing $N_2$ to the plasma stream. Rockwell C hardness in region a is 34-40, and 53-66 in region b. Image height is 1 inch.

A Ti 6-4 work piece was treated with a PTA torch using two different conditions. The resultant work piece is shown in FIG. 6. For the area on the left, the surface indicated by the white line was treated with an amperage of 52 amps, a torch speed of 1.5 IPM, $N_2$ was used as a shield gas, but no $N_2$ was fed through the torch powder feed holes. Thus, no $N_2$ was fed directly into the plasma arc. No melting or change in surface roughness was observed, and the $R_C$ was measured as 34-40, the same hardness as measured for the Ti-6-4 starting work piece. For the area on the right side of FIG. 6, the amperage was maintained at 52 amps, the torch speed was increased to 0.3 IPM, $N_2$ was used as a shield gas, and the flow of $N_2$ through the torch powder feed holes was 4.5 SCFH. No melting was observed, but there was a roughening of the surface. This is attributed to the formation of TiN, which has a smaller molecular volume than Ti metal. The specific volume of Ti is 0.22 $cm^3$/gm and the specific volume of TiN is 0.185 $cm^3$/gm, a decrease of 16%. This volume change results is a roughening of the surface by the PTA plasma nitridation without melting. The Rockwell C hardness of this area (b in FIG. 6) was 53-66, a considerable increase over that of the left size which did not utilize a nitrogen high temperature plasma. These results show that $N_2$ must be introduced into the plasma stream for the surface nitridation to occur. This is evidenced by the increase in hardness that is accompanied by an increase in roughness. The materials described in this example were produced using a Stellite, Excaliber model torch which is rated to produce 16 lb/hr of weldment at a maximum amperage of 300 watts. The voltage in the PTA process in this example was maintained at 28+/−3 volts. The torch to workpiece distance was fixed at ~5-8 mm. The spot size for the torch is a diameter of ~3 mm. Thus the current density for the materials in this example was ~0.2 KW/$mm^2$. Other torches could be used to achieve the same results with a suitable adjustment in processing conditions, particularly torch amperage, distance to the work piece/substrate and the rate of travel of the torch as well as any pulsing of power to the torch.

Example 4

Example 2 was repeated with a torch amperage of 52 amps, a nitrogen flow through the powder feed holes of 7 SCFH, and a torch travel speed of 0.15 IPM. After cooling to room temperature, the $R_C$ was measured as 70.

Example 5

Example 2 was repeated with a torch amperage of 52 amps, a nitrogen flow through the powder feed holes of 5 SCFH, and a torch travel speed of 0.3 IPM. After cooling to room temperature, the $R_C$ was measured as 55.

Example 6

Example 2 was repeated using a steel substrate with 2% C, with a torch amperage of 45 amps, a nitrogen flow through the powder feed holes of 7 SCFH, and a torch travel speed of 0.15 IPM. After cooling to room temperature, the $R_C$ was measured as 33. The $R_C$ of the original untreated steel substrate was 23.

Example 7

Example 2 was repeated using an Al substrate, with a torch amperage of 55 amps, a nitrogen flow through the powder feed holes of 7 SCFH, and a torch travel speed of 0.15 IPM. After cooling to room temperature, the $R_C$ was measured as 15. The $R_C$ of the original untreated Al substrate was 11.

Example 8

Example 2 was repeated with a torch amperage of 25 amps, a flow of a 50/50 mixture of nitrogen and propane fed through the powder feed holes of 5 SCFH, and a torch travel speed of 0.2 IPM. The composition of the surface conversion was a mixture of TiN and TiC which included a solid solution of TiCN.

Example 9

Example 2 was repeated with a torch amperage of 25 amps, a flow of propane fed through the powder feed holes of 5 SCFH, and a torch travel speed of 0.4 IPM. The converted surface consisted of TiC which had a hardness of $R_C$65-75.

Example 10

Example 2 was repeated with a torch amperage of 25 amps, a flow of boron trichloride and hydrogen gasses fed through the powder feed holes of 5 SCFH, and a torch travel speed of 0.4 IPM. The converted surface consisted of titanium boride which had a hardness of $R_C$65-75.

Example 11

A Ti-6-4 substrate in the form of a 4" diameter by ½" thick disc was placed in the chamber of the PTA SFFF unit. A schematic of the PTA SFFF process is shown in FIG. 1. The inert gas chamber was purged with Ar gas until the $O_2$ level was measured as 25 ppm with a Model 1000 Oxygen Analyzer from Advanced Micro Instruments, Inc. The PTA torch was started using Ar as the torch gas and as the shielding gas. A continuous Ti-6-4 wire with a diameter of 0.080" was fed into the chamber and melted by the PTA torch so as to deposit onto the Ti substrate. By adjusting the operating parameters of the PTA torch, conditions were established to deposit a layer of ~0.050" thickness of Ti-6-4 on the disc. The shield gas and inert chamber gas were then switched to $N_2$ and another layer was deposited on the disc. Upon cooling to room temperature and removal from the PTA unit, the deposit was machined so as to provide a flat top surface. The Rockwell C hardness of the surface layer was measured at 68 Rockwell C. This compares to results of 46 Rockwell C for Ti-6-4 deposited by PTA SFFF using an Ar atmosphere. The disc was tested by Wedeven Associates in a ball on disc lubricated friction test designed to simulate performance in a gear box. The wear resistance of the deposited disc was determined running against a carburized 9310 ball and found to perform comparably to a carburized 9310 ball running against a carburized 9310 disc. Both materials performed much better than a Ti alloy disc running against a carburized 9310 ball.

Example 12

A Ti-6-4 substrate in the form of a 6"×6"×½" flat plate was placed in the chamber of the PTA SFFF unit. The inert gas chamber was purged with Ar gas until the $O_2$ level was measured as 25 ppm with a Model 1000 Oxygen Analyzer from Advanced Micro Instruments, Inc. The PTA torch was started using Ar as the torch gas and as the shielding gas. A spherical powder of Ti-6-4 with a particle size range between −8/+320 mesh was fed into the torch and melted by the PTA torch so as to deposit onto the Ti substrate. By adjusting the operating parameters of the PTA torch, conditions were established to deposit multiple layers with a size of 1"×4" of Ti-6-4 on the substrate. The total thickness built up in this was ~0.5". The shield gas and inert chamber gas were then switched to $N_2$ and another layer was deposited on the test bar. Upon cooling to room temperature and removal from the PTA unit, the deposit was machined so as to provide a flat top surface. The Rockwell C hardness of the surface layer was measured at 75 Rockwell C.

Example 13

A Ti-6-4 substrate in the form of a 1"×6"×½" flat plate was placed in the chamber of the PTA SFFF unit. The inert gas chamber was purged with $N_2$ gas until the $O_2$ level was measured as 25 ppm with a Model 1000 Oxygen Analyzer from Advanced Micro Instruments, Inc. The PTA torch was started using Ar as the torch gas and $N_2$ as the shielding gas. The surface of the Ti-6-4 plate was processed by exposure to the PTA torch operating with a $N_2$ atmosphere, but without the introduction of Ti powder or wire. By adjusting the operating parameters of the PTA torch, conditions were established to produce a surface layer of high TiN content and a total layer thickness of ~0.1". Upon cooling to room temperature and removal from the PTA unit, the deposit was machined so as to provide a flat top surface. The plate was machined on the face with the TN so as to provide a flat smooth surface with a thickness of the TiN layer of ~0.050". The Rockwell C hardness of the surface layer was measured at 70 Rockwell C. A test bar was machined from the plate with the dimensions of 0.33"×0.33×4.0". The bar was tested in 4 point bending with the TiN surface up. The load on the bar was increased to 4000 pounds, at which point the test was stopped. The calculated bend stress was 216 Ksi. The bar had deflected and had a curvature of 0.1". No cracking or delamination of the TiN surface layer or the Ti-6-4 substrate could be observed. A bar was also tested for heat resistance in comparison to Ti-6-4. A sample of each material with dimensions ~1"×3"×1" thick was placed in the PTA chamber and exposed to the plasma arc. The voltage was ~28 volts. The power level was initially set at 50 amps and the samples were subjected to heating by the torch. The power level (heat input) was increased in ~5 amp increments until melting of the sample was observed. For the Ti-6-4, this occurred at 80 amps. For the TiN surface on Ti-6-4, melting was not observed until the power level was 105 amps, or a 31% increase in heat flux compared to the Ti-6-4. At 100 amps, there did not appear to be any damage or cracking in the TiN surface layer.

It should be understood that the preceding is merely a detailed description of one embodiment of this invention and that numerous changes to the disclosed embodiment can be made in accordance with the disclosure herein without departing from the spirit or scope of the invention, which is defined by the following claims.

We claim:

1. A method of providing a surface layer on an electrically conductive work piece substrate, the method comprising:

using a scanning plasma torch to impinge a high temperature arc plasma stream on the surface of the work piece, said plasma stream comprising an initial plasma stream and a stream of nitrogen gas or a carbon containing gas that is blended into the initial plasma stream, said work piece forming an electrode and completing an electrical circuit with said plasma arc and the torch power supply, said plasma having sufficient energy to ionize the nitrogen gas or the carbon containing gas, so as to heat the surface of the substrate to a temperature below the melting point of the metal;

causing the metal substrate to react with the nitrogen ions or carbon ions forming a composite surface layer of the metal and the corresponding metal nitride or the corresponding metal carbide; and directing a cooling jet stream of an inert gas onto the plasma heated area of the substrate.

2. The method of claim 1, wherein the initial plasma gas comprises at least one of Ar, He, and a mixture of Ar and $H_2$, and $N_2$ is blended into the hot plasma gas in a controlled manner so as to achieve homogeneous mixing.

3. The method of claim 1, wherein the plasma torch comprises a plasma transferred arc, TIG, or MIG torch.

4. The method of claim 1, wherein the metal substrate comprises a metal selected from the group consisting of Ti, Ta, Cr, Fe, Ni, Co, Al and, an alloy of one or more of said metals.

5. The method of claim 1, wherein a carbon containing gas is used in addition to the $N_2$ gas.

6. The method of claim 1, wherein the surface layer has a thickness of from about 5 microns to about 2500 microns.

7. The method of claim 1, wherein the increase in hardness is at least about 10% as measured by the Rockwell C method.

8. The method of claim 1, wherein the substrate is Ti-6-4 and the hardness of the coated substrate is from about 45 to about 85 as measured by the Rockwell C method compared to a hardness of about 34-39 for the unreacted Ti-6-4.

9. The method of claim 1, wherein the substrate surface is heated to a temperature of about 10° C. to about 200° C. below that of the melting point of the substrate.

10. A method according to claim 1, wherein the plasma stream has a temperature in a range from about 3,000° C. to about 10,000° C., a pressure from about 0.01 to about 0.5 Mpa, and power density from about 10 to about 1000 W/mm$^2$.

11. A method of thermo-chemical treatment including nitriding, carbonizing, carbonitriding, and boronating of a metal work piece substrate using a direct arc plasma stream, comprising the steps of:

providing said metal work piece;

using the work piece as an electrode to create an initial high temperature arc plasma stream;

blending nitrogen and/or carbon containing gases and/or $BCl_3$ inside of said plasma stream causing decomposition of said gases to atoms and ionization of the atoms to obtain an active plasma mix;

scanning said active plasma mix in a stream along a surface of said substrate in a duration sufficient to locally heat said substrate to a temperature about 5-200° C. lower than the melt temperature of the substrate to permit nitrogen and/or carbon ions and/or boron ions to be absorbed by the heated area; and directing a cooling jet stream of an inert gas onto the plasma heated area of the substrate to obtain a desired structure or property in at least part of said substrate.

12. The method of claim 11, wherein the plasma stream has an initial temperature between about 3,000-10,000° C., a pressure between about 0.01-0.5 Mpa, a gas composition of pure argon or argon containing up to 5% of hydrogen, and a power density between 10-1000 W/mm$^2$.

13. The method of claim 11, including the step of controlling direction and linear speed of said active gas or gas mix.

14. The method of claim 11, including the step of controlling direction and linear speed of materials flowing inside said plasma stream.

15. The method of claim 13, wherein the direction and linear speed of said active gas or gas mix, or the direction and linear speed of materials flowing inside said plasma stream are controlled based on initial plasma stream parameters.

16. A method of claim 11, including the step of controlling distance between the plasma torch and substrate surface, and contact time.

17. A method of claim 11, including the step of controlling trajectory and linear speed of said trajectory.

18. A method of claim 11, including the step of controlling cooling based on a temperature difference between an initial substrate temperature and the temperature in a spot of contact of said plasma stream with said substrate surface, and an initial temperature of said substrate, and the parameters of artificial cooling or preheating of the substrate.

* * * * *